United States Patent [19]

Miyoshi et al.

[11] Patent Number: 4,671,750

[45] Date of Patent: Jun. 9, 1987

[54] SCREW ROTOR MECHANISM WITH SPECIFIC TOOTH PROFILE

[75] Inventors: Kiyotada Miyoshi, Kobe; Noboru Tsuboi; Kunihiko Nishitani, both of Hyogo; Kazuo Kubo, Kobe; Shouji Yoshimura, Hyogo, all of Japan

[73] Assignee: Kabushiki Kaisha Kobe Seiko Sho, Kobe, Japan

[21] Appl. No.: 884,070

[22] Filed: Jul. 10, 1986

[51] Int. Cl.[4] ..... F04G 18/16

[52] U.S. Cl. ..... 418/150; 418/201; 74/458

[58] Field of Search ..... 418/150, 201; 74/424.5, 74/458, 459

[56] References Cited

U.S. PATENT DOCUMENTS

| | | | |
|---|---|---|---|
| 3,773,444 | 11/1973 | Koch | 418/201 |
| 4,460,322 | 7/1984 | Schibbye | 418/201 |
| 4,492,546 | 1/1985 | Kasuya | 418/201 |
| 4,508,496 | 4/1985 | Bowman | 418/201 |
| 4,527,967 | 7/1985 | Ingalls | 418/201 |
| 4,576,558 | 3/1986 | Tanaka | 418/201 |
| 4,583,927 | 4/1986 | Shigekawa | 418/201 |

*Primary Examiner*—John J. Vrablik
*Assistant Examiner*—Jane E. Obee
*Attorney, Agent, or Firm*—Oblon, Fisher, Spivak, McClelland, & Maier

[57] ABSTRACT

A screw rotor mechanism which includes a female rotor F having tooth crests each being formed by a leading side arc g2-a2 overlying a tooth tip circle Cf thereof and a following side are a2-b2 having its center at a point 07 on a pitch circle Pf thereof, and a male rotor M having tooth tips each being formed by an arc c1-d1 having its center at an interaxial line passing through axes Of,Om of the female and male rotors F,M. The male rotor M also has tooth bottoms being complementary to tooth female tooth crests or tips and forms no seal grooves thereon. The thus shaped rotors are adapted to be machined with a high efficiency by a gear hobbing machine.

4 Claims, 6 Drawing Figures

SCREW ROTOR MECHANISM WITH SPECIFIC TOOTH PROFILE

BACKGROUND OF THE INVENTION

1. Field of the Invention

The present invention relates to a screw rotor mechanism for use in screw compressors or the like, and more particularly to a pair of asymmetrically toothed male and female rotors each having teeth of a specific profile adapted to be machined by a gear hobbing machine by which machining at an increased rate during its manufacturing is achieved 2. Description of the Prior Art A screw compressor was originally invented by Krigar in Germany in about 1878 and ever since various improvements have been made in this connection. In place of the so-called symmetrically toothed rotors which were used in the original screw compressor, SRM (Svenska Rotor Maskiner Aktiebolag) of Sweden introduced in 1965 asymmetrically toothed rotors with markedly improved volumetric efficiency. An example of the asymmetrically toothed rotors can be seen, for instance, in U.S. Pat. No. 3,423,017. Such rotors of the asymmetrical teeth have been progressively improved in recent times. The applicant of the present invention has also invented a rotor mechanism which is disclosed in U.S. Pat. No. 4583927, as schematically shown in FIG. 5 of the accompanying drawings.

The rotors of FIG. 5 were improvements over earlier rotors in having achieved an increase of a theoretical volume thereof. The male and fomale rotors, designated at reference numerals M,F, respectively, have respective teeth shaped with the following characteristics.

(1) Female Rotor Tooth Shape

The female rotor, F has an addendum Af on the outer side of a pitch circle Pf of its teeth and a dedendum Df on the inner side of the pitch circle Pf. The tooth shapes on the leading and following sides of the female rotor F are as follows.

(a) Tooth shape on the leading side

Profile d2-e2 is formed by an arc having its center at the intersection m of the pitch circle Pf and a straight line passing through the respective centers or axes Of,Om of the female and male rotors F,M. Point d2 is located on the interaxial line Of-Om.

Profile e2-f2 is a tangent passing through Point e2. Point f2 is located on the pitch circle Pf.

Profile f2-g2 is formed by an arc having its center S on a line which extends perpendicularly to the line e2-f2, and passes through Point f2. Point g2 is located on an arc having its center at the axis Of.

(b) Tooth shape on the following side

Profile d2-c2 is a generating curve which is determined by Point d1 of the male rotor M.

Profile c2-b2 is an arc having its center at Point t on a tangent passing through Point b2 on the pitch circle Pf.

Profile b2-a2 is an arc having its center at Point q on the pitch circle Pf. Point a2 is located on an arc having its center at the axis Of.

(2) Male Rotor Tooth Shape

The male rotor M has a dedendum Dm complementary to the addendum Af of the female rotor F. The tooth shapes on the leading and following sides of the male rotor are as follows.

(a) Tooth shape on the leading side

Profile d1-e1 is formed by an arc having its center at the intersection m of its pitch circle Pm and the interaxial line Of-Om. This arc is complementary to the arc d2-e2 of the female rotor F. Point d1 is located on the interaxial line Om-Of.

Profile e1-(f1)-g1 is a generating curve determined by a line e2-(f2)-g2 of the female rotor F. Point f1 is located on the pitch circle Pm and Point g1 is located on a root circle of the male rotor M.

(b) Tooth shape cn.the following side

Profile d1-b1 is a generating curve determined by the arc c2-b2 of the female rotor F. Point b1 is located on the pitch circle Pm.

Profile b1-a1 is an arc complementary to the arc b2-a2 of the female rotor F. Point a1 is located on the root circle of the male rotor M.

The rotors described hereinabove have a remarkedly advantageous volumetric efficiency owing to an increased theoritical volume, but on the other hand the rotors have an objectionable difficulty in manufacturing or shaping the same by a gear hobbing machine. The foregoing drawback in shaping is due to the existance of sharp edge configurations defining the rotor teeth which impairs the proper operation of the gear hobbing machine. Such a sharp edge configuration, for instance, can be seen on edges at Point a2 of the female rotor F and point d1 of the male rotor M (FIG. 5), a sealing edge E of the female rotor F, and a sealing groove E' of the male rotor M (FIG. 6). The arc a1-b1 of the male rotor M has a substantially small radius complementary to that of the arc b2-a2 of the female rotor F. Therefore the opposite corner defined by the arc a1-b1 in a tooth bottom of the male rotor M consequently has a sharp edge configuration very close to a right angle.

For achieving shaping of an increased number of such portions having the sharp edge configuration, it is required to use a machining tool which has a correspondingly increased number of cutting edges of similarly sharp edge configurations. Those cutting edges, however, are apt to increase objectionable friction and/or cause chipping thereof during machining operation, thus requiring frequent reshaping or re-sharpening of the tool, and thus resulting in a shortened life of the tool which will in turn increase its manufacturing cost. In case the rotor tooth of such sharp edge configurations is shaped by means of the gear hobbing machine, chipping occurs at an increased rate since a cutting system of the hobbing machine provided by generating motions of its cutting edges or hob teeth requires the hob teeth to engage the portion to be machined for an elongated time. Consequently, the provision of hob teeth having such sharp configurations will make it impracticable to use the gear hobbing machine for mass production of such rotors. Particularly, the machining of the seal grooves in the tooth bottoms of the male rotor M is one of the greatest restrictions which makes it impracticable to use the hobbing machine for manufacturing a large number of the rotors of such type. Owing to these obstacles, it has been a common practice to use formed cutters for individually machining the rotor teeth.

SUMMARY OF THE INVENTION

According to the present invention, a screw rotor mechanism comprises a female screw rotor F including an addendum disposed on the outer side of a pitch circle of its teeth thereof and a male screw rotor M including a dedendum disposed on the inner side of a pitch circle of its tooth roots or bottoms thereof, the dedendum having a profile complementary to that of the addendum, wherein the female rotor includes a tooth tip profile which is formed with a curve including a leading side arc substantially overlying its tooth tip circle and a following side arc having its center at a point on its pitch circle, and the male rotor includes a tooth bottom profile which is formed with a curve including a leading side arc overlying its tooth root circle and a following side arc having its center at a point on its pitch circle. The male rotor also includes a tooth tip profile which is formed with an arc having its center at a point on the interaxial line passing through the axes of the female and male rotors.

It is therefore an object of the present invention to provide a pair of male and female rotors having their tooth profiles which are formed such that the rotors provide an increased conventional theoretical volume and are suited to be machined by a gear hobbing machine.

Another object of the invention is to provide a pair of male and female rotors in which the number of sharp edge configurations in their tooth profiles are minimized so as to be suited for hobbing machining without decreasing the volumetric efficiency attained by the conventional screw rotor mechanism.

The above and other objects, features and advantages of the present invention will become apparent from the following description and appended claims, taken in conjunction with the accompanying drawings which show by way of example some illustrative embodiments of the invention.

DETAILED DESCRIPTION OF THE PREFERRED EMBODIMENT

Figure 1:
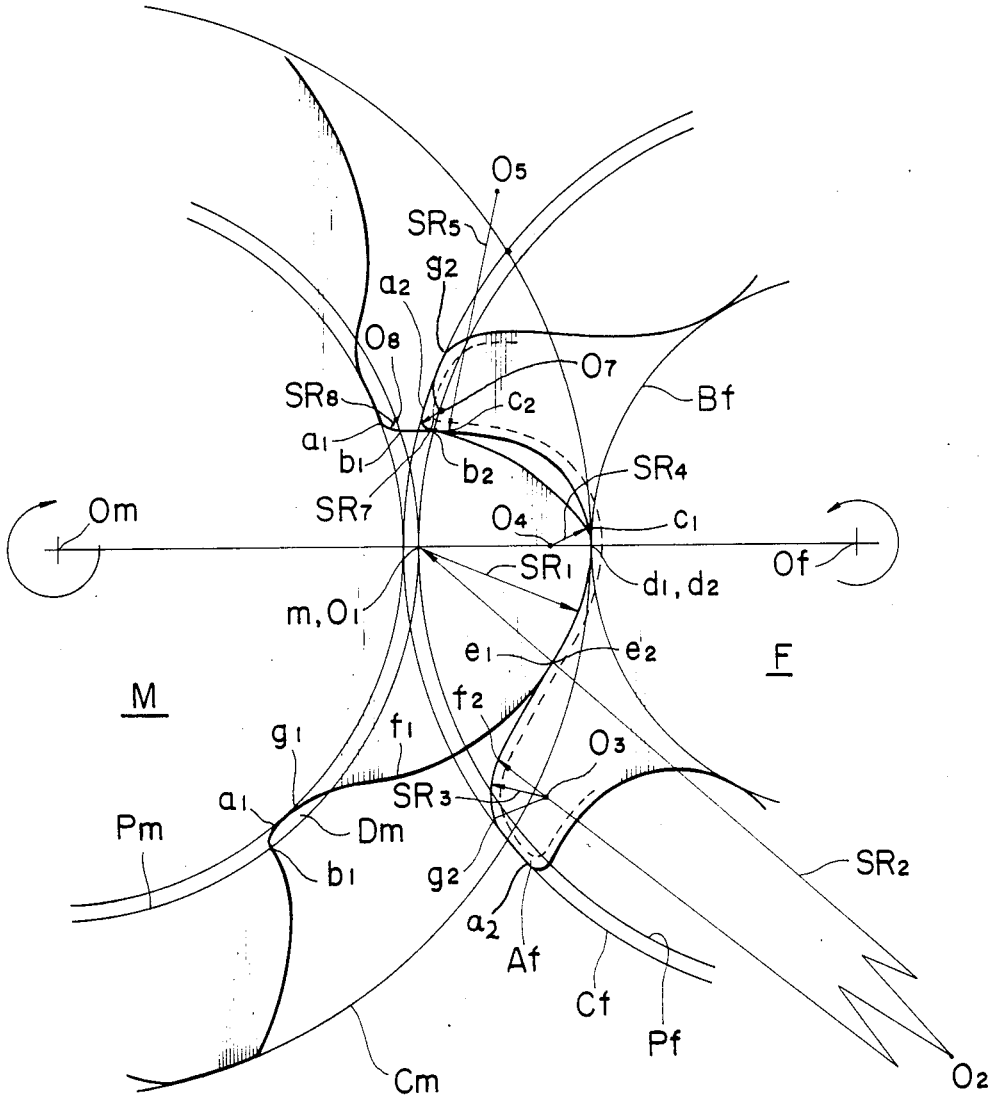
FIG. 1 is a cross-sectional view of a mating couple of male and female rotors according to the invention, showing rotor tooth profiles thereof in a plane perpendicular to the axes of the rotors.

FIG. 1 shows the tooth shapes of male and female rotors M, F. The female rotor F has an addendum Af disposed on the outer side of a pitch circle Pf of its teeth, while the male rotor M has a dedendum Dm disposed on the inner side of a pitch circle Pm of its roots, the dedendum Dm being complementary to the addendum Af.

The female and mele rotors F, M have respective teeth of the following shapes.

(1) Female Rotor Tooth Shape

The female rotor F has tooth shapes on the leading side and the following side as described hereinbelow.

(a) Tooth shape on the leading side

Profile d2-e2 is an arc which has a radius SR1 and its center at an intersection O1 of the pitch circle Pf and a straight line passing through respective centers or axes Of,Om of the female and male rotors. Point d2 is located on the interaxial line Of-Om and also on a root circle Bf of the female rotor.

Profile e2-f2 is an arc which has a radius SR2 and its center O2 on an extension line of a radius O1-e2. Point f2 is located on the inner side of the pitch circle Pf.

Profile f2-g2 is an arc which has a radius SR3 and its center at Point O3 located on a radius O2-f2. Point g2 is located on a tip circle Cf of the female rotor F.

Profile g2-a2 is formed by an arc overlying the tip circle Cf.

(b) Tooth shape on the following side

Profile d2-c2 is a generating curve which is determined by an arc d1-c1 of the male rotor M.

Profile c2-b2 is an arc which has a radius SR5 and its center at Point O5. Point b2 is located on the pitch circle Pf. A tangent to the arc c2-b2 intersects at Point b2 with a tangent to the pitch circle Pf at a right angle. The arc c2-b2 and the generating curve d2-c2 are circumscribed by each other.

Profile b2-a2 is an arc which has a radius SR7 and its center at Point O7 located on the pitch circle Pf.

(2) Male Rotor Tooth Shape

The male rotor M has tooth shapes on the leading and following sides as descibed hereinbelow.

(a) Tooth shape on the leading side

Profile d1-e1 is an arc which has a radius equal to the radius SR1 and its center at an intersection m of the pitch circle Pm and the interaxial line Of-Om, the arc being complementary to the arc d2-e2 of the female rotor F. Point d1 is located on the interaxial line Of-Om and also on a tip circle Cm of the male rotor M.

Profile e1-f1 is a generating curve which is determined by the arc e2-f2 of the female rotor F. Point f1 is located on the outer side of the pitch circle Pm.

Profile f1-g1 is a generating curve which is determined by the arc f2-g2 of the female rotor F.

Profile g1-a1 is formed by an arc overlying a root circle Bm of the male rotor M.

(b) Tooth shape on the following side

Profile d1-c1 is an arc which has its center at Point O4 and a radius SR4.

Profile c1-b1 is a generating curve which is determined by the arc b2-c2 of the female rotor F. Point b1 is located on the pitch circle Pm. The generating curve c1-b1 is inscribed by the arc d1-c1.

Profile b1-a1 is an arc which has a radius SR8 and its center at Point O8 located on the pitch circle Pm.

Figure 2:
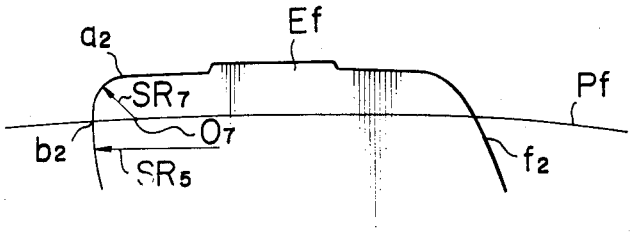
FIG. 2 is an enlarged fragmentary cross-sectional view of a tooth tip of the female rotor shown in FIG. 1.
Figure 3:
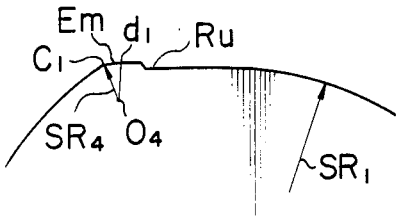
FIG. 3 is an enlarged fragmentary cross-sectional view of a seal edge of the male rotor shown in FIG. 1.

As specifically shown in FIGS. 2 and 3, the female rotor F has a seal edge or projection Ef disposed on the arc a2-g2 thereof, and the male rotor M has a seal edge Em in this particular embodiment.

Figure 5:
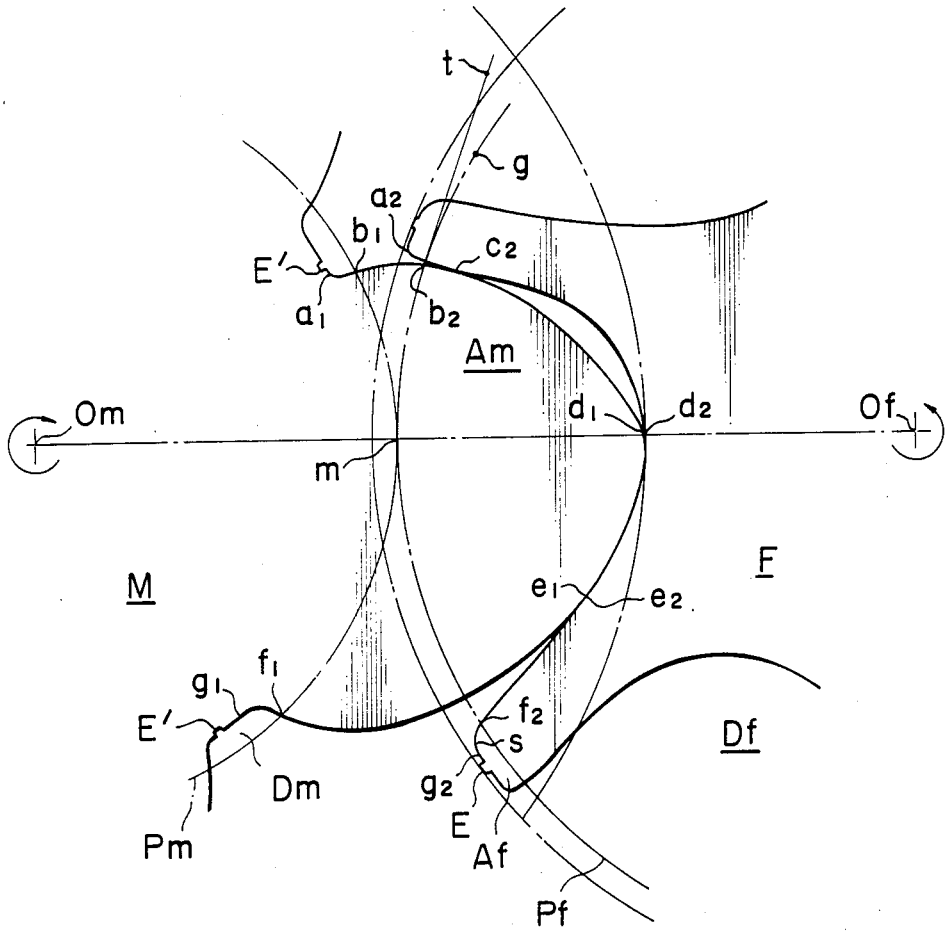
FIGURE 5 PRIOR ART
FIG. 5 is a cross-sectional view of a mating couple of the conventional male and female rotors, showing the rotor tooth profiles in a plane perpendicular to the axes of the rotors.
Figure 6:
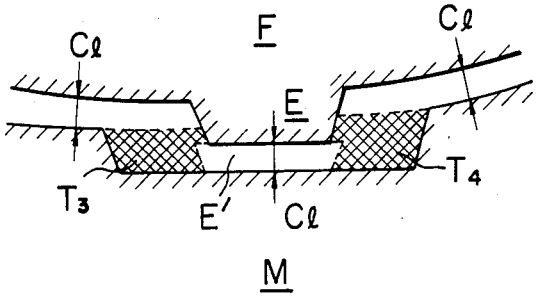
FIGURE 6 PRIOR ART
FIG. 6 is an enlarged fragmentary view similar to FIG. 4, showing the manner in which the conventional female sealing edge intermeshes with the conventioanl male rotor sealing groove.

The seal edge Ef of the present female rotor tooth tip has a height considerably smaller than that of the seal edge of the conventional female rotor. Specificaly, the height of the conventional seal edge illustrated in FIGS. 5 and 6 is approximately <(outside diameter of female rotor)$\times 3\times 10^{-3}$ $\mu$m>, while the height of the seal edge of the invention is approximately <(outside diameter of female rotor)$\times 5\times 10^{-4}$ $\mu$m>. The seal edge Em of the tooth tip of the present male rotor has a step-like portion formed by removing a peripheral portion Ru from a leading side tooth portion defined by the arc d1-e1.

In this embodiment of the present invention, the female and male rotors F, M have a number of inventive features as described hereinbelow.

The female and male rotors F,M do not include sharp edge configurations, except for those of the seal edges Ef, Em. It can be well understood by comparing these configurations with those of the conventional rotors in FIG. 5. To describe this more specifically, the present female rotor tooth has in its tooth crest the arc b2-a2 in place of a sharp edge a2 of the conventional female rotor tooth, thus resulting in a tooth bottom corner defined by the arc b1-a1 of the male rotor M, which is complementary to the arc b2-a2, being broader than the bottom corner of the conventional male rotor. The tooth bottom of the male rotor M includes neither a seal groove nor a sharp edge. Accordingly, the present rotors have only a minimum number of sharp edge configurations which may be machined by a correspondingly decreased number of hob teeth having sharp edge configurations. As a result, it becomes possible to use in a practical manner the gear hobbing machine in shaping those rotor teeth.

The present female rotor teeth have an increased width and thus an increased mechanical strength, while the male rotor roots have a correspondingly increased width.

These improvements are due to the arrangement that Point f2 of the female rotor F from which the arc of the radius SR3 extends is located inside the pitch circle Pf thereof, while Point f1 of the male rotor M corresponding to Point f2 is located outside the pitch circle Pm thereof. Such increased widths are suitable for hob machining.

In view of a volumetric efficiency, the present rotor tooth shapes are no more disadvantageous than the conventional rotor tooth shapes. In comparison with the conventional female rotor, the present female rotor is in fact disadvatageous in that the arcuate tip corner of the arc b2-a2 on the female rotor tooth provides a blow hole larger than the sharply edged tip corner of the coventional female rotor tooth, while the present female rotor is advantageous in that the arcuate tip corner provides jointly with a tooth flank of the male rotor M a seal line shorter than that provided by the conventional rotors. Thus there is not a substantial difference between the present and conventional rotor teeth in view of the volumetric efficiency.

Described hereinbelow is how the volumetric efficiency is influenced by a resulting flat tooth bottom of the male rotor M by omitting the seal groove therefrom. In order to compare the present rotors with the conventional rotors in view of the volumetric efficiency, a tooth tip-to-bottom gap area (referred to as 'tooth gap area' hereinbelow) which is defined by a mating pair of the female tooth tip and the male tooth bottom is considered.

Figure 4:
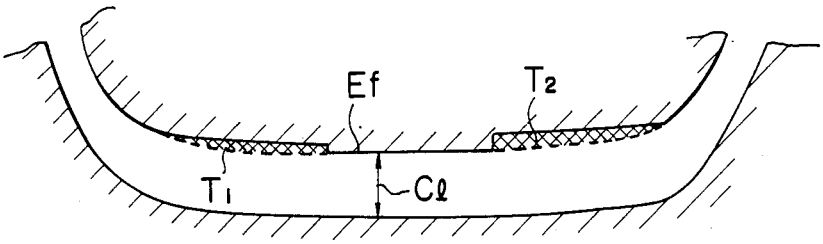
FIG. 4 is an enlarged fragmentary view of the male and female rotors of FIG. 1, showing the manner in which the female rotor sealing edge intermeshes with the male rotor bottom.

Respective tooth gap areas are illustrated as the dotted area in FIGS. 4 and 6, in which each tooth tip is set to be spaced apart from the mating tooth bottom by a distance Cl <normally (outside diameter of male rotor)$\times 4\times 10^{-4}$ $\mu$m>. The dimensional difference between the two tooth gap areas is determined by a difference between opposite side portions of the seal edge Ef of the invention (FIG. 4),i.e. dotted areas T1 and T2 and opposite side portions of the conventional seal groove E' (FIG. 6), i.e. dotted areas T3 and T4. In the conventional rotors, the width of the seal groove E' must be sufficiently larger than the width of the seal edge E. Generally, the respective widths of the seal edge E and the seal groove E' are determined by <(outside diameter of male rotor)$\times 5\times 10^{-3}$ $\mu$m> and <(outside diameter of male rotor)$\times 0.015$ $\mu$m>. This dimensional difference therebetween is deliberately established partly because an intermeshed pair of female and male rotors operatively mounted in a compressor casing will inevitably create a certain amount of backlash, and partly because it is necessary to avoid an interference between the seal edge E and the seal groove E' in consideration that a catch point where the seal edge E starts to engage the seal groove E' is dislocated from a release point where the former leaves the latter.

In the embodiment of the present invention, the seal edge Ef has a substantially smaller height, namely, about 50 $\mu$m which is approximately one sixth of that of the conventional seal edge E for thereby minimizing the gap areas T1,T2. Consequently, the present tooth gap area T1+T2 can be set to be equal to or larger than the conventional tooth gap area. The tooth gap area around the seal edge is one of the decisive factors which determine a leakage amount of the compressed air at the suction side and hence the compression efficiency. Although the seal groove has been removed from the bottom of the male rotor of the present invention, the gap area around the seal edge is decreased to be as small as or smaller than the conventional gap area by providing a deliberately minimized height of the female rotor seal edge as described hereinabove, thus preventing a decrease in volumetric efficiency.

In view of sealing, the present rotors are advatageous in that a flaw if any created locally in the arc d2-c2 could impair the seal line only locally since the couple of male and female rotors are intermeshed in such a manner that the arc d1-c1 of the male rotor sealing edge Em may generate the arc d2-c2 of the female rotor F. On the other hand, the conventional seal edge E is disadvantageous in that any flaw created in the point d1 would seriously impair the sealing effect of the seal line since the couple of male and female rotors M, F are intermeshed in such a manner that the male rotor sealing edge formed by the point d1 will generate the arc d2-c2 of the female rotor F as described hereinabove.

Obviously, numerous modification and variations of the present invention are possible in light of the above teachings. It is therefore to be understood that within the scope of the appended claims the invention may be practiced otherwise than as specifically described herein.

What is claimed as new and desired to be secured by Letters Patent of the United States is:

1. A screw rotor mechanism for use in compressors or the like, comprising:

a pair of male and female rotors, wherein said female rotor (F) has in a tooth profile thereof an addendum (Af) disposed on the outer side of a first pitch circle (Pf) of the teeth thereof, and said male rotor (M) has in a tooth profile thereof a dedendum (Dm) disposed on the inner side of a second pitch circle (Pm) of teeth roots thereof, said dedendum (Dm) being complementary to said addendum (Af), said female rotor (F) including:

a leading side tooth profile thereof including, a first arc (d2-e2) of a radius (SR1) having a center thereof at an intersection (01) of said first pitch circle (Pf) of said female rotor and an interaxial line passing through centers of (Of, Om) of said female and male rotors, a second arc (e2-f2) of a radius (SR2) having a center thereof at a first point (02) on an extension line of a radius (01-e2), a third arc (f2-g2) of a radius (SR3) having a center thereof at a second point (03) on a radius (02-f2), and a second arc (g2-a2) overlying a first tooth tip circle (Cf) of said female rotor, said arcs being succeedingly connected in this order, wherein a third point (d2) is located on said interaxial line (Of-Om) and on a second tooth root circle (Bf) of said female rotors (F), and a fourth point (f2) is located on the inner side of said first pitch circle (Pf), and also wherein a seal edge (Ef) is disposed integrally on said second arc (g2-a2) to project outwardly of said first tooth tip circle (Cf); and a following side tooth profile thereof including, a first generating curve (d1-c1) which is determined by a fourth arc (d1-c1) of said male rotor M, a fifth arc (c2-b2) of a radius (SR5) having its center on a fifth point (05), and a sixth arc (b2-a2) of a radius (SR7) having its center at a sixth point (07) on said first pitch circle (Pf) of said female rotor (F), said first generating curve and said third, fourth and fifth arcs being succeedingly connected in this order, wherein a sixth point (b2) is located on said first pitch circle (Pf);

said male rotor (M) including:

a leading side tooth profile including, a seventh arc (d1-e1) of said radius SR1 having its center at an intersection (m) of said second pitch circle (Pm) and said interaxial line (Of-Om), a second generating curve (e1-f1) which is determined by said second arc (e2-f2) of said female rotor (F), a third generating curve (f1-g1) which is determined by said third arc (f2-g2) of said female rotor (F), an eighth arc (g1-a1) overlying a tooth root circle (Bm) of said male rotor (M), said seventh and eighth arcs and said second and third generating curves being succeedingly interconnected in this order, wherein a seventh point (d1) is located on said interaxial line (Of-Om) and on said second tooth root circle (Bf), and an eighth point (f1) is located on the outer side of said second pitch circle (Pm) of said male rotor and a following side tooth profile including, a ninth arc (d1-c1) of a radius (SR4) having a center thereof at a ninth point (04) on said interaxial line (Of-Om), a fourth generating curve (c1-b1) determined by said arc (b2-c2) of said female rotor (F), and a tenth arc (b1-a1) of a radius (SR8) having a center thereof at a point (08) on said second pitch circle (Pm), said ninth and tenth arcs and said fourth generating curve being succeedingly interconnected in this order, wherein a tenth point (b1) is located on said second pitch circle (Pm) of said male rotor.

2. A screw rotor mechanism according to claim 1, wherein the total number of the teeth of said male rotor (M) is five, and the total number of the teeth of said female rotor (F) is six.

3. A screw rotor mechanism according to any one of claims 1 or 2, said female rotor (F) including on each tooth tip thereof a seal projection (EF) having a height represented by (outside diameter of female rotor)$\times 5 \times 10^{31\ 4}$ $\mu$m.

4. A screw rotor mechanism according to any one of claims 1 or 2, said male rotor (M) including on each tooth tip portion thereof a seal edge (Em) defined by a resulted profile which is formed upon removal of a peripheral portion from a leading side tooth portion on said seventh arc (d1-e1).

* * * * *